US005997790A

United States Patent [19]

Vos et al.

[11] Patent Number: 5,997,790

[45] Date of Patent: Dec. 7, 1999

[54] PROCESS FOR THE PREPARATION OF REGENERATED CELLULOSE FILAMENTS

[75] Inventors: Gerardus Hendricus Vos; Bernardus Maria Koenders, both of Westervoort; Hanneke Boerstoel, Arnhem, all of Netherlands

[73] Assignee: Michelin Recherche et Technique S.A., Granges-Paccot, Switzerland

[21] Appl. No.: 09/097,534

[22] Filed: May 19, 1998

Related U.S. Application Data

[63] Continuation of application No. PCT/EP96/04662, Oct. 25, 1996.

[30] Foreign Application Priority Data

Nov. 20, 1995 [NL] Netherlands ..... 1001692

[51] Int. Cl.[6] ..... D01D 10/06; D01F 2/02; D01F 2/28

[52] U.S. Cl. ..... 264/187; 264/211.12; 264/211.15; 264/211.16; 264/233; 264/234

[58] Field of Search ..... 264/187, 211.12, 264/211.15, 211.16, 233, 234

[56] References Cited

U.S. PATENT DOCUMENTS

| | | |
|---|---|---|
| 4,370,168 | 1/1983 | Kamide et al. . |
| 4,839,113 | 6/1989 | Villaine et al. . |
| 5,571,468 | 11/1996 | Meraldi et al. . |

FOREIGN PATENT DOCUMENTS

| | | |
|---|---|---|
| WO9116357 | 10/1991 | WIPO . |
| WO9520629 | 8/1995 | WIPO . |

*Primary Examiner*—Leo B. Tentoni
*Attorney, Agent, or Firm*—Baker & Botts, L.L.P.

[57] ABSTRACT

The disclosure describes a process for the preparation of regenerated cellulose filaments from an anisotropic solution including cellulose formate, phosphoric acid, and formic acid in which the formed cellulose formate filaments are dried to a moisture content of not more than 15% prior to regeneration and after regeneration the filaments are washed and dried under low tension. In this manner cellulose multifilament yarns of high breaking load and high elongation at break can be obtained, which in addition have a very regular linear density.

7 Claims, No Drawings

PROCESS FOR THE PREPARATION OF REGENERATED CELLULOSE FILAMENTS

This is a continuation of copending International Application No. PCT/EP96/04662 filed Oct. 25, 1996.

BACKGROUND OF THE INVENTION

The invention pertains to a process for the preparation of regenerated cellulose filaments from an anisotropic solution containing cellulose formate, phosphoric acid, and formic acid, which process comprises the following steps:

extruding the solution through capillaries, passing the formed cellulose formate filaments through a layer of air, passing the cellulose formate filaments through a coagulation bath, washing the cellulose formate filaments with water, regenerating the cellulose formate filaments, washing the formed regenerated cellulose filaments with water, drying the regenerated cellulose filaments, and winding the regenerated cellulose filaments.

SUMMARY OF THE INVENTION

Such a process is known from WO 85/05115.

This patent application discloses the dissolution of cellulose in a solvent containing formic acid and phosphoric acid. The resulting anisotropic solution, which contains cellulose formate, is spinnable and can be processed by means of an air gap-wet spinning process. Cellulose formate filaments obtained in this manner can be regenerated using NaOH. The resulting regenerated cellulose filaments have a high breaking load and a high modulus as compared with the regenerated cellulose filaments which can be made by the viscose process. However, the elongation at break of the filaments which can be made by the process of WO 85/05115 is comparatively low, generally in the range of 3 to 4%. Moreover, the filaments have a morphology which appears to be built up of layers embedded in each other which surround the axis of the filament. This morphology appears to vary pseudoperiodically along the axis of the filament. Such a pseudoperiodical morphology can also be described as a banded structure. This banded structure can be made visible with a polarisation microscope.

WO 94/17136 describes a process for spinning filaments from isotropic solutions containing cellulose formate. While the filaments obtained in this manner have an elongation at break of more than 4%, their breaking load is comparatively low.

Surprisingly, a process has now been found by means of which regenerated cellulose filaments of high breaking load and high elongation at break can be obtained, viz by drying the cellulose formate filaments prior to their regeneration and washing and drying them under a comparatively low tension after they have been regenerated.

The invention consists in that in a process according to the opening paragraph the cellulose formate filaments are dried to a moisture content less than 20% prior to regeneration and after regeneration the filaments are washed and dried under a tension of less than 2.5 cN/tex.

Using the process according to the invention, multifilament yarns having the following combination of favorable properties can be obtained:

$0<DS<1\%$, $CV<2$.

breaking load: 700–1200 mN/tex, elongation at break >5%.

DESCRIPTION OF PREFERRED EMBODIMENTS

In this process DS, the degree of substitution of cellulose, is measured in a manner described below, and CV stands for the coefficient of variation of the yarn's linear density measured over a great length of a multifilament yarn.

Preparation of the Solution

An anisotropic spinning solution containing cellulose formate, formic acid, and phosphoric acid (=orthophosphoric acid, $H_3PO_4$) can be obtained as described in WO 85/05115, by adding cellulose to a solvent containing formic acid and hosphoric acid. In order to obtain a readily spinnable solution, the solvent preferably contains formic acid and phosphoric acid in a weight ratio of 0.05 to 0.7, more particularly of 0.2 to 0.4, especially of about 0.3. Preferably, 13–27 parts by weight (pbw) of cellulose and 87–73 pbw of the solvent are mixed to obtain a solution containing 100 parts by weight in all. An economically advantageous process will employ a spinning solution having a high concentration of cellulose, e.g., 22 wt. %.

The cellulose to be used preferably has an α-content of more than 90%, more particularly exceeding 95%. For spinning quality filaments from the solutions it is recommended to employ "dissolving pulp" having a high α-content, such as is generally used for making textile and industrial application fibers. Examples of suitable types of cellulose are Arbocell BER 600/30, Buckeye V5, V60 or V65, Viscokraft, and Ultranier. The degree of polymerisation (DP) of the cellulose, as determined by the procedure mentioned in this patent application, advantageously is in the range of 350 to 1500, more particularly in the range of 500 to 1350.

Cellulose in its commercially available form will usually contain some water and can be employed as such without any objection. Of course, it is also possible to employ dried cellulose, but this is not essential.

The anisotropic solution can be obtained by intimately mixing the solvent and the cellulose in an appropriate kneader, e.g., an IKA-duplex kneader, a Linden-Z kneader, or a LIST-mixer.

Cellulose formate is formed by some reaction between cellulose and formic acid. In this way cellulose formate can be obtained which has a degree of substitution (DS) of more than 10%, more particularly in the range of 15 to 40%.

Extruding the Spinning Solution and Coagulating the Filaments

The resulting solution can be spun or extruded through a spinneret plate with the desired number of capillaries. Preferably, spinning solutions having a cellulose concentration in the range of 13 to 27 wt. % are extruded at a temperature between 20° and 70° C., with the residence period at the higher temperatures being as short as possible. Preferably, such solutions are extruded at a temperature between 40° and 60° C. For other concentrations it holds that as the concentration is higher, so the spinning temperature preferably will also be higher than the ranges indicated here, and vice versa.

The desired number of orifices in the spinneret plate is dependent on the future use of the filaments to be obtained. Thus, a single spinneret plate having the desired number of capillaries may be used not only for extruding monofilaments but also for extruding multifilament yarns (containing from 30 to 10 000 filaments, preferably from 100 to 2000 filaments) much in demand in actual practice. The manufacture of such multifilament yarns preferably is carried out on a cluster spinning assembly containing a number of capillaries clusters such as described in EP 168 876, or on a spinning assembly having one or more spinnerets of the type described in WO 95/20696.

Following extrusion, the extrudates are passed through a layer of air. In this layer the extrudates are drawn. The selection of the thickness of this layer is dependent on the linear density and the desired degree of drawing of the extrudates. Preferably, use is made of a layer of air having a thickness in the range of 4 to 150 mm. The layer between the spinneret plate and the coagulation bath can be filled not only with air, but also with some other gas, a vapour, or a mixture of these, e.g., with nitrogen. Due to evaporation the coagulant will also be present in the layer in the gaseous form. If so desired, the quantity of gaseous coagulant in the layer can be reduced, e.g., by regularly changing the gas or the vapour in the layer.

Next, the obtained extrudates are passed through a coagulation bath in a manner known in itself. As suitable coagulants for obtaining filaments of high breaking load and high elongation at break may be selected low boiling, a-polar organic liquids which do not have a swelling effect on cellulose, water, or mixtures thereof. Examples of such suitable coagulants include alcohols, ketones, ester, and water, or mixtures thereof. Preference is given to the use of acetone as coagulant.

The temperature of the coagulation bath preferably is in the range of −40° C. to 10° C. The strongest filaments are obtained if the temperature of the coagulant is less than −10° C. If acetone is used as coagulant, the temperature of the coagulation bath preferably is in the range of −30 to −10° C. It was found that filaments of high breaking load and high elongation at break can be obtained if the tension measured on the filaments immediately beyond the coagulation bath is less than 2 cN/tex, more particularly less than 1 cN/tex.

Washing the Coagulated Filaments

After coagulation the filaments are washed out with water. In order to keep the tension on the filaments as constant as possible during washing, it is preferred to pass the filaments through the washing liquid in a continuous process. According to a process highly suited for use in actual practice, washing out is performed using washing plates or so-called jet washers, such as described in British patent specification GB 762.959. The washing out can take place at any temperature between 0° and 100° C. Preferably, washing out takes place at any temperature between 15° and 60° C. If any coagulant is left in the filament bundle, it is preferred to have the washing out take place at a temperature below the coagulant's boiling point. It has been found that the washing out of phosphoric acid in particular is of major importance in obtaining a multifilament yarn of high breaking load and high elongation at break. Preferably, the washing out is carried out in such a way that after being washed the yarn will contain less than 0.2 wt. % of $H_3PO_4$, preferably less than 0.15 wt % of $H_3PO_4$ Washing efficiency can be enhanced by washing out the yarn under the lowest possible tension.

Drying the Cellulose Formate Filaments

After being washed, the cellulose formate filaments are dried and, optionally, wound. It was found that the drying of the cellulose formate filaments is of major importance in obtaining a regenerated cellulose yarn of high breaking load and high elongation at break. Furthermore, the degree to which the filaments were dried was found to be significant. In order to obtain regenerated filaments of high breaking load and high elongation at break, the filaments should be dried in such a way that the multifilament yarn contains less than 20% of moisture. It was also found that the tension during washing and/or drying is of key importance in obtaining a regenerated yarn of high breaking load and high elongation at break. Such yarns can be obtained if during the washing and/or drying of the formate yarn the tension is between 4 and 16 cN/tex.

According to a process highly suited to be used in actual practice, in a continuous process the filaments are dried using one or more driven heated rollers, with the filaments making several turns around the heated rollers. The tension on the filaments for the drying process can be set by means of a difference in speed between the first driven heated roller and a driven roller at the end of the washing range.

In this way the tension on the yarn during drying can be set independently of the tension on the yarn during washing. It was found to be impossible to obtain a regenerated multifilament cellulose yarn of high breaking load if the cellulose formate yarn is dried under such conditions as to give an initial modulus of the formate yarn of less than 18 N/tex. A formate yarn initial modulus of more than 18 N/tex can be obtained, e.g., by applying tension to the yarn during drying. This tension is dependent, int. al, on the DP of the cellulose in the yarn. After being dried, the multifilament cellulose formate yarn can be wound on a bobbin, but this is not essential.

Regeneration of the Cellulose Formate Filaments

Regeneration can be carried out immediately following on from the washing and drying processes, as well as after the multifilament yarn has been wound. In an especially favorable embodiment the filaments are regenerated in a continuous process. The regenerant can be brought into contact with the filaments by being passed through a bath, spraying, the use of a kiss roll, or a bath equipped with jet washers. Preferably, all of the regenerant is added in one go. Alternatively, the yarn can be regenerated in a discontinuous manner, e.g., by being immersed in a bath filled with the regenerant wound on a (perforated) tube or as a strand. It was found that NaOH makes a highly suitable regenerant and that, in a continuous process, an NaOH solution having an NaOH concentration in the range of 15 to 50 wt. % is particularly suitable for use as a regenerant. In a discontinuous process an NaOH solution with a lower NaOH concentration can be used, e.g., a solution with an NaOH concentration of about 5 wt. %. It was further found that the temperature during regeneration affects the properties of the regenerated cellulose filament yarn to be obtained. In order to prevent the temperature from rising too high during regeneration, the regenerant preferably has a temperature of less than 30° C., more particularly below 20° C. It is further preferred that the yarn temperature not be too high either, e.g., a temperature below 30° C. The tension during regeneration was not found to have a significant effect on the properties of the yarn obtained in this manner. However, it will be self-evident to the skilled person that the tension selected for regeneration should not be so high as to cause the yarn to break.

Washing of the Regenerated Cellulose Filaments

It was found that regenerated filaments having exceptionally favorable breaking load and elongation at break among other properties can be obtained if the filaments are regenerated under low tension. After regeneration the regenerated cellulose filaments are washed out with water, preferably in the manner already described above. Preferably, the filaments are washed with water having a temperature of 15–90° C. The temperature in the initial part of the washing range is preferably chosen between 15 and 30° C. In the process according to the invention the tension during washing is less than 2.5 cN/tex, preferably below 1 cN/tex.

Drying of the Regenerated Cellulose Filaments

After being washed, the regenerated cellulose filaments are dried. In order to obtain regenerated cellulose filaments having favorable properties, such as a high breaking load and a high elongation at break, it is preferred that the filaments be dried under low tension. According to a process highly suited for use in actual practice, the filaments are dried with the aid of one or more driven heated rollers. If the filaments are dried in this manner, the tension on the filaments in advance of the first drying roller is controlled such that it is kept below 2.5 cN/tex, more particularly below 1 cN/tex. In a favorable process the filaments are dried to a moisture content of less than 20%, more particularly to about 8%, using a single roller having a surface temperature of about 150–180° C. In an especially favorable process the filaments are dried using two heated rollers, with the yarn being dried to a moisture content of about 20% using the first roller, and to a moisture content of 7–8% using a second roller. In this process the tension on the yarn between the two drying rollers should be kept as low as possible, preferably below 1 cN/tex, more particularly below 0.5 cN/tex. After being dried, the regenerated cellulose filaments are wound. Also during the winding process the tension on the filaments is preferably kept as low as possible. However, the selected tension will not be so low as to give an irregular build-up of the yarn package.

In the above description the tensions listed have always been dependent on the linear density of the filaments. To calculate the tensions, the force applied to the filaments in their longitudinal direction is divided in each case by the linear density of the regenerated filaments. In the case of a multifilament yarn, the tension can be calculated by dividing the force applied to the yarn in its longitudinal direction by the linear density of the regenerated yarn. The applied force can be measured with a yarn extensometer.

Properties of the Multifilament Yarns

Using the process according to the invention regenerated cellulose multifilament yarns can be obtained which have the following combination of properties rendering the yarns especially suitable for use as a reinforcing material:

$0<DS<1\%$, $CV<2$.

breaking load: 700–1200 mN/tex, and elongation at break >5%.

DS is a measure of the esterification of the cellulose molecules with formate groups. The lower the DS value, the lower the number of formate groups will be and the more satisfactorily regenerated the yarn. Yarns having a high DS value may decompose, with formic acid being released in the course of the reaction. CV provides information on the regularity of the yarn over a great length (some tens of meters, more particularly about the regularity of the linear density. Lower CV values go with greater yarn regularity. Generally speaking, greater yarn regularity will be obtained through a stable spinning process with few fluctuations in the conditions. Moisture fluctuations in the yarn and fluctuations in tension can give rise, e.g., to an irregular linear density. A stable spinning process will find expression not only in great regularity of the yarn's linear density, but also in great regularity of the yarn's other properties, e.g., its breaking load and elongation at break. Regularity matters greatly in industrial application of the yarn. Preferably, the yarn has a CV value of less than 2, more particularly of less than 1. Other important parameters with regard to the material's use are breaking load and elongation at break. The yarn preferably has an elongation at break of 6–8%.

In addition to the aforesaid combination of favorable properties, the multifilament yarns, or the filaments from which the yarns are built up, have the following properties:

The filaments do not exhibit a banded structure. The absence of a banded structure is an indication of the filaments' great structural regularity. This is reflected in a greater yarn regularity.

The filaments have a compression strength of greater than 0.25 GPa. a high compression strength is of advantage if the filaments, optionally in a multifilament yarn, are exposed to a compression load.

The yarn has an initial modulus of higher than 15 N/tex. The initial modulus is a measure of the yarn's stiffness. Such stiffness can be an important factor for various applications.

The combination of properties renders this multifilament yarn highly suitable for use as a reinforcing material, more particularly as a reinforcing material in rubber articles which can be subjected to dynamic load. One example of this is the yarn's use as a reinforcing material in conveyor belts, V-belts, and vehicle tyres. More particularly, the yarn is suitable for use as a reinforcing material in pneumatic tyres for cars Generally speaking, the now found filaments constitute a favorable alternative to industrial yarns such as polyamide, rayon, polyester, and aramid. Further, the filaments can be pulped. Such pulp, which may be mixed with other materials, such as carbon pulp, glass pulp, aramid pulp, or polyacrylonitrile pulp, or not, is highly suited to be used as a reinforcing material, e.g., in asphalt, cement and/or friction materials.

Measuring Methods

Determination of DP

The degree of polymerisation (DP) of the cellulose was determined with the aid of an Ubbelohde type 1 (k=0.01). To this end the cellulose specimens to be measured were dried in vacuo for 16 hours at 50° C. after neutralisation, or the amount of water in the copper II ethylene diamine/water mixture was corrected to take into account the water in the cellulose. In this way an 0.3 wt. % of cellulose-containing solution was made using a copper II ethylene diamine/water mixture (1/1).

On the resulting solution the viscosity ratio (visc. rat. or $\eta_{rel}$) was determined, and from this the Limiting Viscosity Number ($\eta$) was determined in accordance with the formula:

$$[\eta] = \frac{visc.rat - 1}{c(k \times c \times (visc.rat.-1))} \times 100$$

wherein c=cellulose concentration of the solution (g/dl) and k=constant=0.25

From this formula the degree of polymerisation DP was determined as follows:

$$DP = \frac{[\eta]}{0{,}42} \quad (\text{for } [\eta] < 450 \text{ ml/g}),$$

or

-continued $$DP^{0.76} = \frac{[\eta]}{2,29} \quad (\text{for } [\eta] > 450 \text{ ml/g})$$

Determining the DP of the cellulose in the solution proceeded as described above after the following treatment:

20 g of the solution were charged to a Waring Blender (1 litre), 400 ml of water were added, and the whole was then mixed at the highest setting for 10 minutes. The resulting mixture was transferred to a sieve and washed thoroughly with water. Finally, there was neutralisation with a 2%-$NaHCO_3$ solution for several minutes and after-washing with water. The DP of the resulting product was determined as described above, starting from the preparation of the copper II ethylene diamine/water/cellulose solution.

Determination of $H_3PO_4$ Content

The $H_3PO_4$ Content was determined by titration with the aid of an E672 titroprocessor. To this end 50 meters of yarn were measured off and rinsed several times with demineralised water, the water being collected in a beaker and the yarn being squeezed dry over the beaker after every rinsing cycle with the aid of tweezers. The contents of the beaker were subjected to potentiometric titration in the titroprocessor at a rate of 1 ml/min using an 0.1 M NaOH solution. The $H_3PO_4$ content in the yarn can be calculated as follows:

$$H_3PO_4(\text{wt. }\%)=[(V_2-V_1)\times t_1\times 98\times 100]/P$$

wherein $V_1$=the quantity (in ml) of 0.1 M NaOH solution used for equivalency point 1, $V_2$=the quantity (in ml) of 0.1 M NaOH solution used for equivalency point 2.

$t_1$=the strength of the NaOH solution, and

P=the weighed quantity of dried yarn, with the yarn after being rinsed having been dried for some time at 120° C.

Determination of DS

DS was determined by means of titration with the aid of an E 672 titroprocessor. To this end 50 meters of yarn were measured off and rinsed several times with demineralised water, the yarn being squeezed dry after each rinsing cycle with the aid of tweezers. To the rinsed yarn 10 ml of a 1.0 M NaOH solution and 75 ml of boiled demineralised water were added in a beaker. The contents of the beaker were stirred under nitrogen for some 15 minutes. Next, the contents of the beaker were subjected to potentiometric titration in a titroprocessor at a rate of 1 ml/min using a 1.0 M HCl solution. A blank determination, i.e., without any yarn, was also carried out. The DS can be calculated as follows:

$$DS\ (\text{mole }\%)=(A_3/3)/[(A_3/3)+(P-246\times A_3/3)/162]\times 100$$

wherein $A_3=(V_4-V_3)\times t_2$,

P=the weighed quantity of dried yarn, with the yarn, after rinsing and titration, having been dried for some time at 20° C., $V_4$=the quantity (in ml) of 1.0 M HCl solution used for measuring the yarn specimen, $V_3$=the quantity (in ml) of 1.0 M HCl solution used for the blank determination, and $t_2$=the strength of the HCl solution.

Anisotropy of the Solution

Solutions are considered to be anisotropic if birefringence is observed in a condition of rest. Generally speaking, this holds for measurements carried out at room temperature. However, solutions which can be processed—e.g., by fibre spinning—at temperatures below room temperature and which display anisotropy at said lower temperature are considered anisotropic also. The birefringence Δn was determined with the aid of an Abbe refractometer type B, e.g., as described in W. H. de Jeu, *Physical properties of Liquid Crystalline Materials*(London: Gordon & Breach, 1980), p. 35.

Mechanical Properties

The mechanical properties of the filaments and the yarns were determined in accordance with ASTM standard D2256-90, using the following settings. The filament properties were measured on filaments clamped with Arnitel® gripping surfaces of 10×10 mm. The filaments were conditioned for 16 hours at 20° C. and 65% relative humidity. The length between grips was 100 mm and the filaments were elongated at a constant elongation of 10 mm/min. The yarn properties were determined on yarns clamped with Instron 4C clamps. The yarns were conditioned for 16 hours at 20° C. and 65% relative humidity. The length between clamps was 500 mm and the yarns were elongated at a constant elongation of 50 mm/min. The yarns were twisted, the number of twists per meter being 4000√linear density [dtex]. The linear density of the filaments, expressed in dtex, was calculated on the basis of the functional resonant frequency (ASTM D 1577–66, Part 25, 1968); the yarn's linear density was determined by weighing. The breaking tenacity, elongation, and initial modulus were derived from the load-elongation curve and the measured filament or yarn linear density The initial modulus (In. Mod.) was defined as the maximum modulus at an elongation of less than 2%.

Determination of CV

The CV value of a yarn is determined with the aid of an USTER Tester Zeliweger. In this measurement the yarn is passed through the measuring sensor for 5 minutes under a tension of more than 7 cN at a rate of 50 m/min, the sensor measuring any fluctuations in the dielectric constant of the yarn.

Determination of Compression Strength

The compression strength of filaments was determined by means of the Elastica test. In this test a filament loop is tightened while at the same time the shape of the loop is studied under a microscope. During the elastic deformation the shape of the loop does not change. The elongation at which the loop's shape does change is taken to be the critical compression strain. Assuming that the compression stress-strain curve is the mirror image of the elongation stress-strain curve, the compression strength can be calculated from the elongation stress-strain curve measured as the strength at the elongation equal to the critical compression strain. For further information about the Elastica test reference may be had to, e.g. D. Sinclair, *J.Appl.Phys.*, 21 (1950), 380–386.

Moisture Content of the Yarn

The moisture content of the yarn was determined with the aid of a Mahlo Texto meter, type DMB-6. The Rayon scale is used to measure the moisture content of cellulose bobbins.

EXAMPLES

The invention will be elucidated with reference to examples.

Example 1c, 3, 5, 10, 12, 18, and 20 are comparative examples. Below, it is indicated in which respects the comparative examples differ from the invention:

Example Differs from the invention in that:

1c The moisture content of the formate yarn is not lower than 20%.

3 The tension during washing and drying of the formate yarn is less than 4 cN/tex.

5 The tension during washing and/or drying of the formate yarn is greater than 16 cN/tex.

10 The DP of cellulose is below 350.

12 The breaking load of the regenerated cellulose yarn is less than 700 mN/tex.

18 The tension during washing and/or drying of the regenerated yarn is greater than 2.5 cN/tex.

20 The breaking load and the elongation at break of the yarn are less than 700 mNttex and 5%, respectively.

Example 1

In a Linden-Z kneader 78 parts by weight (pbw) of solvent (formic acid/orthophosphoric acid, weight ratio 0.30) and 22 pbw of cellulose (Viskokraft, DP=700) were mixed and kneaded until a homogeneous anisotropic solution was obtained. The solution was passed via a 5 μm candle filter to a spinneret of 54° C. with 375 capillaries each having a diameter of 65 μm. The solution was spun through a 24 mm air gap into an acetone coagulation bath of −10° C. The tension on the filaments after they were passed through this bath was 0.7 cN/tex. Next, the filaments were passed through a washing range where they were washed with water of about 12° C. At the end of the washing range the tension on the filaments was 5.4 cN/tex. Due to the different speeds of a driven roller beyond the washing range and a heated drying roller having a temperature of 150° C., the filaments were dried under a tension of 6.0 cN/tex. By varying the number of turns around the drying roller the moisture content in the filaments was varied. Next, the filaments were wound at a rate of 120 m/min. Some properties of the thus obtained cellulose formate multifilament yarn are given in Table 1. The cellulose formate filaments were then regenerated by applying a 20 wt. % NaOH solution in water of a temperature of 25° C. After this, the formed regenerated cellulose filaments were washed, dried to a moisture content of 8%, and wound at a rate of about 120 m/min. During the filaments' regeneration the tension was 0.2 cN/tex, during washing of the filaments it was 0.8 cN/tex, and during drying it was 0.4 cN/tex. Some properties of the thus obtained regenerated cellulose yarn are given in Table 2.

Example 2

In a Linden-Z kneader 78 pbw of solvent (formic acid/orthophosphorc acid, weight ratio 0.30) and 22 pbw of cellulose (Viskokraft, DP=700) were mixed and kneaded until a homogeneous anisotropic solution was obtained. The solution was passed via a 5 μm candle filter to a spinneret of 53° C. with 375 capillaries each having a diameter of 65 μm. The solution was spun through a 27 mm air gap into an acetone coagulation bath of −10° C. The tension on the filaments after they were passed through this bath was 0.7 cN/tex. Next, the filaments were passed through a water bath, where they were washed with water of about 50° C. At the end of the water bath the tension on the filaments was 5.3 cN/tex. Due to the different speeds of a driven roller beyond the water bath and a heated drying roller having a temperature of 150° C., the filaments were dried under a tension of 3.5 cN/tex. The filaments were dried to a moisture content of 7.5%. Next, the filaments were wound at a rate of 120 m/min. Some properties of the thus obtained cellulose formate multifilament yarn are given in Table 1. The cellulose formate filaments were then regenerated by applying a 20 wt. % NaOH solution in water of a temperature of 25° C. After this the formed regenerated cellulose filaments were washed, dried to a moisture content of 7%, and wound at a rate of about 60 m/min. During the filaments' regeneration the tension was 0.6 cN/tex, during washing of the filaments it was 0.5 cN/tex, and during drying it was 0.3 cN/tex. Some properties of the thus obtained regenerated cellulose yarn are given in Table 2.

Example 3 (Comparative example)

In the same manner as described in Example 2 a yarn was spun and regenerated. However, the cellulose formate filaments were washed under a tension of 1.0 cN/tex and dried under a tension of 0.8 cN/tex. Some properties of the thus obtained cellulose formate multifilament yarn are given in Table 1. Some properties of the thus obtained regenerated cellulose yarn are given in Table 2.

Example 4

In a Linden-Z kneader 78 pbw of solvent (formic acid/orthophosphoric acid, weight ratio 0.30) and 22 pbw of cellulose were mixed and kneaded until a homogeneous anisotropic solution was obtained. The solution was passed via a 10 μm candle filter to a spinneret of 59° C. with 250 capillaries each having a diameter of 65 μm. The solution was spun through a 63 mm air gap into an acetone coagulation bath of −9° C. The tension on the filaments after they were passed through this bath was 1.2 cN/tex. Next, the filaments were passed through a washing range, where they were washed with water of about 53° C. At the end of the washing range the tension on the filaments was 5.2 cN/tex. Due to the different speeds of a driven roller beyond the washing range and a heated drying roller having a temperature of 150° C., the filaments were dried under a tension of 3.5 cN/tex. The filaments were dried to a moisture content of 85%. Next, the filaments were wound at a rate of 100 m/min. Some properties of the thus obtained cellulose formate multifilament yarn are given in Table 1. The cellulose formate filaments were then regenerated by applying a 30 wt. % NaOH solution in water of a temperature of 20° C. After this, the formed regenerated cellulose filaments were washed, dried, and wound at a rate of about 30 m/min. During the filaments' regeneration the tension was 2.3 cN/tex, during washing of the filaments it was 2.1 cN/tex, and during drying it was 2.0 cN/tex. Some properties of the thus obtained regenerated cellulose yarn are given in Table 2.

Example 5 (Comparative example)

In the same manner as described in Example 2 a yarn was spun and regenerated. However, the cellulose formate filaments were washed under a tension of 5.4 cN/tex and dried under a tension of 18.0 cN/tex. Some properties of the thus obtained cellulose formate multifilament yarn are given in Table 1. Some properties of the thus obtained regenerated cellulose yarn are given in Table 2.

Example 6

In a Linden-Z kneader 82 pbw of solvent (formic acid/orthophosphoric acid, weight ratio 0.30) and 18 pbw of cellulose (V65, DP=1000) were mixed and kneaded until a homogeneous anisotropic solution was obtained. Using a spinning pump the solution was passed to a spinneret of 56° C. with 250 capillaries each having a diameter of 65 μm. The solution was spun through a 6 mm air gap into an acetone coagulation bath of −8° C. The tension on the filaments after they were passed through this bath was 1.2 cN/tex. Next, the filaments were passed through a washing range where they were washed with water of about 58° C. At the end of the washing range the tension on the filaments was 5.5 cN/tex. Due to the different speeds of a driven roller beyond the washing range and a heated drying roller having a temperature of 150° C., the filaments were dried under a tension of 3.7 cN/tex. The filaments were dried to a moisture content of 8.5%). Next, the filaments were wound at a rate of 120 m/min. Some properties of the thus obtained cellulose formate multifilament yarn are given in Table 1. The cellulose formate filaments were then regenerated by applying a 20 wt. % NaOH solution in water of a temperature of 20° C. After this, the formed regenerated cellulose filaments were washed with water of about 54° C., dried, and wound at a rate of about 60 m/min. During the filaments' regeneration the tension was 1.0 cN/tex, during washing of the filaments it was 0.7 cN/tex, and during drying it was 0.4 cN/tex. Some properties of the thus obtained regenerated cellulose yarn are given in Table 2.

Example 7

In the same manner as described in Example 6 cellulose formate yarn was made by spinning the solution through a 12 mm air gap. The tension on the filaments after they were passed through the coagulation bath was 0.9 cN/tex. The filaments were washed with water of about 53° C. The tension during washing was 5.6 cN/tex, during drying it was 3.8 cN/tex. Some properties of the thus obtained cellulose formate multifilament yarn are given in Table 1. This yarn was then regenerated as described in Example 6. Some properties of the thus obtained regenerated cellulose yarn are given in Table 2.

Example 8

In the same manner as described in Example 6 cellulose formate yarn was made by spinning the solution through a 20 mm air gap. The tension on the filaments after they were passed through the coagulation bath was 0.7 cN/tex. The filaments were washed with water of about 53° C. The tension during washing was 5.4 cN/tex, during drying it was 3.8 cN/tex. Some properties of the thus obtained cellulose formate multifilament yarn are given in Table 1. This yarn was then regenerated as described in Example 6. Some properties of the thus obtained regenerated cellulose yarn are given in Table 2.

Example 9

In the same manner as described in Example 6 cellulose formate yarn was made by spinning the solution through a 40 mm air gap. The tension on the filaments after they were passed through the coagulation bath was 0.5 cN/tex. The filaments were washed with water of about 53° C. The tension during washing was, 5.2 cN/tex, during drying it was 3.8 cN/tex. Some properties of the thus obtained cellulose formate multifilament yarn are given in Table 1. This yarn was then regenerated as described in Example 6. Some properties of the thus obtained regenerated cellulose yarn are given in Table 2.

Example 10 (Comparative example)

In a Linden-Z kneader 78.7 pbw of solvent (formic acid/orthophosphoric acid, weight ratio 0.30) and 21.3 pbw of cellulose (V65, DP=1000) were mixed and kneaded until a homogeneous anisotropic solution was obtained. The solution was passed via a 5 μm candle filter to a spinneret of 44° C. with 250 capillaries each having a diameter of 65 μm. The solution was spun through an 18 mm air gap into an acetone coagulation bath of −8° C. The tension on the filaments after they were passed through this bath was 0.4 cN/tex. Next, the filaments were passed through a washing range, where they were washed with water of about 58° C. At the end of the washing range the tension on the filaments was 5.2 cN/tex. Due to the different speeds of a driven roller beyond the washing range and a heated drying roller having a temperature of 150° C., the filaments were dried under a tension of 3.6 cN/tex. The filaments were dried to a moisture content of 8.0%. Next, the filaments were wound at a rate of 120 m/min. Some properties of the thus obtained cellulose formate multifilament yarn are given in Table 1.

The cellulose formate filaments were then regenerated by applying a 20 wt. % NaOH solution in water of a temperature of 20° C. After this, the formed regenerated cellulose filaments were washed with water of about 54° C., dried, and, wound at a rate of about 60 m/min. During the filaments' regeneration the tension was 0.7 cN/tex, during washing of the filaments it was 0.7 cN/tex, and during drying it was 0.4 cN/tex. The multifilament yarn was wound under a tension of 1.2 cN/tex. Some properties of the thus obtained regenerated cellulose yarn are given in Table 2.

Example 11

In a Linden-Z kneader 74.3 pbw of solvent (formic acid/orthophosphoric acid, weight ratio 0.30) and 25.7 pbw of cellulose (V65, DP-700) were mixed and kneaded until a homogeneous anisotropic solution was obtained. Using a spinning pump the solution was passed via a 10 μm candle filter to a spinneret of 55° C. with 250 capillaries each having a diameter of 65 μm. The solution was spun through a 50 mm air gap into an acetone coagulation bath of −11° C. The tension on the filaments after they were passed through this bath was 0.9 cN/tex. Next, the filaments were passed through a washing range, where they were washed with water of about 47° C. At the end of the washing range the tension on the filaments was 5.5 cN/tex. Due to the different speeds of a driven roller beyond the washing range and a heated drying roller having a temperature of 155° C., the filaments were dried under a tension of 2.7 cN/tex. The filaments were dried to a moisture content of 8.5%. Next, the filaments were wound at a rate of 100 m/min. Some properties of the thus obtained cellulose formate multifilament yarn are given in Table 1.

The cellulose formate filaments were then regenerated by applying a 30 wt. % NaOH solution in water of a temperature of 22° C. After this, the formed regenerated cellulose filaments were washed with water of about 58° C., dried and wound at a rate of about 30 m/min. During the filaments' regeneration the tension was 0.6 cN/tex, during washing of the filaments it was 1.4 cN/tex, and during drying it was 0.5 cN/tex. Some properties of the thus obtained regenerated cellulose yarn are given in Table 2.

Example 12 (Comparative example)

In a Linden-Z kneader 88.0 pbw of solvent (formic acid/orthophosphoric acid, weight ratio 0.30) and 12.0 pbw of cellulose V65, DP=700) were mixed and kneaded until a homogeneous anisotropic solution was obtained. Using a spinning pump the solution was passed via a 10 μm candle filter to a spinneret of 5500 with 250 capillaries each having a diameter of 65 μm. The solution was spun through a 3.5 mm air gap into an acetone coagulation bath of −8° C. The tension on the filaments after they were passed through this bath was 0.8 cN/tex. Next, the filaments were passed through a washing range, where they were washed with water of about 54° C. At the end of the washing range the tension on the filaments was 5.0 cN/tex. Due to the different speeds of a driven roller beyond the washing range and a heated drying roller having a temperature of 150° C., the filaments were dried under a tension of 2.7 cN/tex. The filaments were dried to a moisture content of 9%. Next, the filaments were wound at a rate of 100 m/min. Some properties of the thus obtained cellulose formate multifilament yarn are given in Table 1. The cellulose formate filaments were then regenerated by applying a 33 wt. % NaOH solution in water of a temperature of 22° C. After this, the formed regenerated cellulose filaments were washed with water, dried, and wound at a rate of about 30 m/min. During the filaments' regeneration the tension was 0.5 cN/tex, during washing of the filaments it was 1.4 cN/tex, and during drying it was 0.5 cN/tex. The multifilament yarn was wound under a tension of 1.1 cN/tex. Some properties of the thus obtained regenerated cellulose yarn are given in Table 2.

Example 13

In a List DTB-6 kneader impregnated cellulose obtained by the process described in non-prepublished French patent application FR 9508005, which contained 77.8 pbw of solvent (formic acid/orthophosphoric acid, weight ratio 0.30) and 22.3 pbw of cellulose (V65, DP=700) were mixed and kneaded until a homogeneous anisotropic solution was obtained. The solution was passed via a 5 μm candle filter to a spinneret of 55° C. with 250 capillaries each having a diameter of 65 μm. The solution was spun through a 22 mm air gap into an acetone coagulation bath of −7° C. The tension on the filaments after they were passed through this bath was 0.5 cN/tex. Next, the filaments were passed through a washing range, where they were washed with water of about 49° C. At the end of the washing range the tension on the filaments was 5.7 cN/tex. Due to the different speeds of a driven roller beyond the washing range and a heated drying roller having a temperature of 150° C., the filaments were dried under a tension of 3.7 cN/tex. The filaments were dried to a moisture content of 8.0%. Next, the filaments were wound at a rate of 120 m/min. Some properties of the thus obtained cellulose formate multifilament yarn are given in Table 1. The cellulose formate filaments were then regenerated by applying a 30 wt. % NaOH solution in water of a temperature of 20° C. After this, the formed regenerated cellulose filaments were washed with water of about 52° C. The filaments were dried to a moisture content of about 8% by being passed, under a tension of 0.3 cN/tex, through a tubular oven having an average temperature of about 410° C. The resulting multifilament yarn was wound under a tension of 1.1 cN/tex at a rate of about 30 m/min. During the filaments' regeneration the tension was 0.2 cN/tex. Some properties of the thus obtained regenerated cellulose yarn are given in Table 2.

Example 14

In the same manner as described in Example 13 a cellulose formate yarn was dried, after regeneration, in a tubular oven having an average temperature of about 345° C. under a tension of 0.2 cN/tex. Some properties of the thus obtained regenerated cellulose yarn are given in Table 2.

Example 15

Cellulose formate yarn obtained in the manner described in Example 13 was regenerated by application of a 20 wt. % NaOH solution in water having a temperature of 20° C. Next, the regenerated filaments were washed with water of about 51° C. and dried using two heated rollers each having a temperature of 150° C. The tension during regeneration was 0.7 cN/tex, during washing it was 0.6 cN/tex, for the first drying roller it was 0.6 cN/tex, and for the second drying roller it was 0.3 cN/tex. The yarn was wound under a tension of 1.2 cN/tex at a rate of 30 m/min. Some properties of the thus obtained regenerated cellulose yarn are given in Table 2.

Example 16

In a Linden-Z kneader 80 pbw of solvent (formic acid/orthophosphoric acid, weight ratio 0.20) and 20 pbw of cellulose (V65, DP=700) were mixed and kneaded until a homogeneous anisotropic solution was obtained. The solution was passed via a 10 μm candle filter to a spinneret of 55° C. with 250 capillaries; each having a diameter of 65 μm. The solution was spun through a 15 mm air gap into an acetone coagulation bath of −6° C. Next, the filaments were washed on washing plates with water of about 50° C. The filaments were dried using a heated roller having a temperature of 150° C. and wound at a rate of 100 m/min. The cellulose formate filaments were then regenerated by applying a 30 wt. % NaOH solution in water of a temperature of 22° C. After this, the formed regenerated cellulose filaments were washed on washing plates with water of about 54° C., dried, and wound at a rate of about 30 m/min. During the filaments' regeneration the tension was 0.6 cN/tex, during washing of the filaments it was 1.1 cN/tex, and during drying it was 0.6 cN/tex. The multifilament yarn was wound under a-tension of 1.5 cN/tex. Some properties of the thus obtained regenerated cellulose yarn are given in Table 2.

Example 17

In a List DTB-6 kneader impregnated cellulose obtained by the process described in non-prepublished French patent application FR 9508005, which contained 78 pbw of solvent (formic acid/orthophosphoric acid, weight ratio 0.30) and 22 pbw of cellulose (V65, DP=700) were mixed and kneaded until a homogeneous anisotropic solution was obtained. Using a spinning pump the solution was passed to a spinneret of 55° C. with 375 capillaries each having a diameter of 65 μm. The solution was spun through a 25 mm air gap into an acetone coagulation bath of −5° C. The tension on the filaments after they were passed through this bath was 0.8 cN/tex. Next, the filaments were washed on washing plates with water of about 49° C. At the end of the washing range the tension on the filaments was 5.6 cN/tex. Due to the different speeds of a driven roller beyond the washing section and a heated drying roller having a temperature of 150° C., the filaments were dried under a tension of 3.6 cN/tex. The filaments were dried to a moisture content of 8.0% and wound at a rate of 120 m/min. The cellulose formate filaments were regenerated by applying a 20 wt. % NaOH solution in water of a temperature of 20° C. Next, the formed regenerated cellulose filaments were washed with water of about 52° C. The filaments were dried to a moisture content of about 8% with the aid of two driven heated rollers as described in this application. During regeneration the tension was 0.6 cN/tex, during washing it was 0.5 cN/tex, and for the first drying roller it was 0.3 cN/tex. The yarn was wound under a tension of 1.1 cN/tex at a rate of 60 m/min. cN/tex. properties of the thus obtained regenerated cellulose yarn are given in Table 2. For the compression strength of the filaments in this yarn a value of 0.36 GPa was determined using the method mentioned in this patent specification.

Example 18 (Comparative example)

In a List DTB6 kneader impregnated cellulose obtained by the process described in non-prepublished French patent application FR 9508005, which contained 783 pbw of solvent (formic acid/orthophosphoric acid, weight ratio 0.30) and 22 pbw of cellulose (V65, DP=700) were mixed and kneaded until a homogeneous anisotropic solution was obtained. Using a spinning pump the solution was passed to a spinneret of 55° C. With 375 capillaries each having a diameter of 65 μm. The solution was spun through a 25 mm air gap into an acetone coagulation bath of −5° C. The tension on the filaments after they were passed through this bath was 0.9 cN/tex. Next, the filaments were passed through a washing range and washed with water of about 58° C. At the end of the washing range the tension on the filaments was 11.0 cN/tex. Due to the different speeds of a driven roller beyond the washing section and a heated drying roller having a temperature of 150° C., the filaments were dried under a tension of 7.7 cN/tex. The filaments were dried to a moisture content of 9.0% and wound at a rate of 120 m/min.

The cellulose formate filaments were regenerated by applying a 20 wt. % NaOH solution in water of a temperature of 20° C. Next, the formed regenerated cellulose filaments were washed with water of about 56° C. The filaments were dried to a moisture content of about 8% using a driven heated roller. During regeneration the tension was 0.5 cN/tex, during washing it was 4.4 cN/tex, and for the drying roller it was 4.2 cN/tex. The yarn was wound under a tension of 1.2 cN/tex at a rate of 60 m/min. Some properties of the thus obtained regenerated cellulose yarn are given in Table 2.

Example 19

In a List DTB-6 kneader impregnated cellulose obtained by the process described in non-prepublished French patent application FR 9508005, which contained 79) pbw of solvent (formic acid/orthophosphoric acid, weight ratio 0.30) and 21 pbw of cellulose (V65, DP=700) were mixed and kneaded until a homogeneous anisotropic solution was obtained. Using a spinning pump the solution was passed via a 10 μm candle filter to a spinning assembly having a temperature of 55° C. The spinning assembly had four spinnerets each with 375 capillaries of 65 μm in diameter. The solution was spun through a 30 mm air gap into an acetone coagulation bath of −8° C. The tension on the filaments after they were passed through this bath was 0.9 cN/tex. Next, the filaments were passed through a washing range equipped with jet washers and washed with water Of about 25° C. At the end of the washing range the tension on the filaments was 7.6 cN/tex. Due to the different speeds of a driven roller beyond the washing range and a heated drying roller having a temperature of 175° C. the filaments were dried under a tension of 7.7 cN/tex. The filaments were dried to a moisture content of 8.0% and wound at a rate of 150 m/min. Some properties of the thus obtained cellulose formate multifilament yarn are given in Table 1. The cellulose formate multifilament yarn had a $H_3PO_4$ content of 0.1%. The cellulose formate yarn was regenerated by applying with the aid of a jet washer a 20 wt. % NaOH solution in water of a temperature of 25° C. Next, the formed regenerated cellulose filaments were washed with water of about 72° C. The filaments were dried to a moisture content of about 13% with the aid of a driven heated roller. During regeneration the tension was 0.5 cN/tex, during washing it was 0.6 cN/tex, and for the drying roller it was 0.5 cN/tex. The yarn was wound under a tension of 0.4 cN/tex at a rate of 150 m/min. Some properties of the thus obtained regenerated cellulose yarn are given in Table 2.

Example 20 (Comparative example)

In the same manner as described in Example 19 cellulose formate yarn was obtained. Due to inferior washing, however, the yarn contained a $H_3PO_4$ content of 0.3%. Some properties of the thus obtained cellulose formate multifilament yarn are given in Table 1. Some properties of the thus obtained regenerated cellulose yarn are given in Table 2.

Example 21

In a Linden-Z kneader 78 parts by weight (pbw) of solvent (formic acid/orthophosphoric acid, weight ratio 0.30) and 22 pbw of cellulose (DP=1000) were mixed and kneaded until a homogeneous anisotropic solution was obtained. The solution was passed via a 20 μm candle filter to a spinneret of 57° C. with 250 capillaries each having a diameter of 65 μm. The solution was spun through a 35 mm air gap into an acetone coagulation bath of −12° C. The tension on the filaments after they were passed through this bath was 1.0 cN/tex. Next, the filaments were passed through a washing range where they were washed with water of about 16° C. At the end of the washing range the tension on the filaments was 5.5 cN/tex. Due to the different speeds of a driven roller beyond the washing range and a heated drying roller having a temperature of 150° C., the filaments were dried under a tension of 4.6 cN/tex. By varying the number of turns around the drying roller the moisture content in the filaments was varied. Next, the filaments were wound at a rate of 100 m/min. Some properties of the thus obtained cellulose formate multifilament yarn are given in Table 1 The cellulose formate filaments were then regenerated by applying a 30 wt. % NaOH solution in water of a temperature of 25° C. After this, the formed regenerated cellulose filaments were washed, dried to a moisture content of 7.5%, and wound at a rate of about 50 m/min. During the filaments' regeneration the tension was 0.4 cN/tex, during washing of the filaments it was 0.2 cN/tex, and during drying it was 0.2 cN/tex. Some properties of the thus obtained regenerated cellulose yarn are given in Table 2.

Example 22

In a List DTB-6 kneader a homogeneous anisotropic cellulose solution was obtained which contained 78 pbw of solvent (formic acid/orthophosphoric acid, weight ratio 0.30) and 22 pbw of cellulose (V65, DP=700). The solution was passed via a 10 μm candle filter to a spinneret of 58° C. with 250 capillaries each having a diameter of 65 μm. The solution was spun through a 25 mm air gap into an acetone coagulation bath of −7° C. The filaments were passed through a washing range, where they were washed with water. At the end of the washing range the tension on the filaments was 300 cN. Due to the different speeds of a driven roller beyond the washing range and a heated drying roller having a ternperattire of 150° C., the filaments were dried under a tension of 100 cN. The filaments were dried to a moisture content of 8.5%. Next, the filaments where wound at a rate of 100 m/min. The cellulose formate filaments were then regenerated by applying a 30 wt. % NaOH solution in water of a temperature of 20° C. After this, the formed regenerated cellulose filaments were washed with water of about 52° C. at a tension of 50 cN. The filaments were dried in two steps under a tension of 50 cN in both drying steps. The resulting multifilament yarn was wound at a rates of about 30 m/min. During the filaments' regeneration the tension was 25 cN. Some properties of the thus obtained regenerated cellulose yarn are given in Table 2.

Example 23

In a List DTB6 kneader a homogeneous anisotropic cellulose solution was obtained which contained 78 pbw of solvent (formic acid/orthophosphoic acid, weight ratio 0.30) and 22 pbw of cellulose (V65, DP=700). The solution was passed via a 10 $\mu$m candle filter to a spinneret of 58° C. with 250 capillaries each having a diameter of 65 $\mu$m. The solution was spun through a 25 mm air gap into an acetone coagulation bath of −8° C. The filaments were passed through a washing range, where they were washed with water. At the end of the washing range the tension on the filaments was 300 cN. Due to the different speeds, of a driven roller beyond the washing range and a heated drying roller having a temperature of 150° C., the filaments were dried under a tension of 400 cN. The filaments were dried to a moisture content of 9%. Next, the filaments were wounid at a rate of 100 m/min. The cellulose formate filaments were then regenerated by applying a 30 wt. % NaOH solution in water of a temperature of 20° C. After this, the formed regenerated cellulose filaments were washed with water of about 52° C. at a tension of 60 cN. The filaments were dried in two steps under a tension of 50 cN in both drying steps. The resulting multifilament yarn was wound at a rate of about 30 m/min. During the filaments' regeneration the tension was 25 cN. Some properties of the thus obtained regenerated cellulose yarn are given in Table 2.

TABLE 1

Properties of cellulose formate multifilament yarns

| Example | Moisture content [%] | Yarn linear density [dtex] | Breaking load [mN/tex] | Elongation at break [%] | Initial Modulus [N/tex] |
|---|---|---|---|---|---|
| 1a | 12 | 717 | 735 | 4.3 | 23.7 |
| 1b | 17 | 720 | 690 | 4.3 | 22.7 |
| 1c | 20 | 714 | 700 | 4.5 | 22.1 |
| 2 | 7.5 | 750 | 700 | 4.2 | 23.4 |
| 3 | 7.5 | 746 | 600 | 4.6 | 20.4 |
| 4 | 8.5 | 570 | 740 | 4.0 | 25.5 |
| 5 | — | 557 | 800 | 3.4 | 27.9 |
| 6 | 8.5 | 562 | 570 | 4.3 | 20.6 |
| 7 | 8 | 556 | 580 | 4.2 | 20.9 |
| 8 | 8.5 | 560 | 600 | 4.2 | 21.1 |
| 9 | 8.5 | 553 | 580 | 4.1 | 21.6 |
| 10 | 8.0 | 510 | 430 | 3.4 | 19.9 |
| 11 | 8.5 | 563 | 810 | 4.0 | 26.9 |
| 12 | 9.0 | 562 | 460 | 4.3 | 18.2 |
| 13 | 8.0 | 558 | 468 | 3.7 | 25.2 |
| 19 | 8.0 | 2700 | 690 | 3.8 | 24.2 |
| 20 | 8.0 | 2685 | 610 | 3.7 | 21.6 |
| 21 | 7.5 | 577 | 946 | 4.2 | 28.4 |
| 22 | 8.5 | 574 | 773 | 4.4 | 25.5 |
| 23 | 9.0 | 567 | 800 | 3.7 | 27.3 |

TABLE 2

Properties of regenerated cellulose multifilament yarns

| Example | Yarn linear density [dtex] | DS [%] | Breaking load [mN/tex] | Elongation at break [%] | Initial modulus [N/tex] | Work to break [J/g] | CV [%] |
|---|---|---|---|---|---|---|---|
| 1a | 620 | 0 < DS < 1 | 940 | 6.4 | 22.9 | 29.0 | — |
| 1b | 625 | 0 < DS < 1 | 700 | 5.3 | 22.9 | 19.1 | — |
| 1c* | 625 | 0 < DS < 1 | 570 | 4.5 | 22.1 | 13.8 | — |
| 2 | 670 | 0 < DS < 1 | 890 | 6.6 | 21.3 | — | — |
| 3* | 664 | 0 < DS < 1 | 560 | 4.6 | 21.0 | — | — |
| 4 | 486 | 0 < DS < 1 | 950 | 5.4 | 26.0 | — | — |
| 5* | 480 | 0 < DS < 1 | 920 | 4.9 | 26.4 | — | — |
| 6 | 490 | 0 < DS < 1 | 760 | 6.5 | 20.4 | 24.7 | — |
| 7 | 484 | 0 < DS < 1 | 770 | 6.2 | 20.7 | 23.7 | — |
| 8 | 484 | 0 < DS < 1 | 760 | 6.5 | 20.4 | 24.4 | — |
| 9 | 489 | 0 < DS < 1 | 800 | 6.1 | 21.5 | 23.9 | — |
| 10* | 450 | 0 < DS < 1 | 500 | 5.7 | 15.7 | 14.7 | — |
| 11 | 490 | 0 < DS < 1 | 900 | 6.0 | 25.0 | 26.3 | — |
| 12* | 491 | 0 < DS < 1 | 570 | 5.3 | 20.5 | 15.7 | — |
| 13 | 551 | 0 < DS < 1 | 810 | 7.1 | 21.8 | 29.6 | 1.96 |
| 14 | 510 | 0 < DS < 1 | 780 | 7.2 | 20.8 | 27.7 | 1.63 |
| 15 | 507 | 0 < DS < 1 | 790 | 7.0 | 19.9 | 27.7 | — |
| 16 | 490 | 0 < DS < 1 | 850 | 6.3 | 23.4 | — | 0.74 |
| 17 | 636 | 0 < DS < 1 | 850 | 6.1 | 22.4 | 25.0 | — |
| 18* | 620 | 0 < DS < 1 | 920 | 4.5 | 27.2 | — | — |
| 19 | 2414 | 0 < DS < 1 | 800 | 5.8 | 19.9 | 22.3 | — |

TABLE 2-continued

Properties of regenerated cellulose multifilament yarns

| Example | Yarn linear density [dtex] | DS [%] | Breaking load [mN/tex] | Elongation at break [%] | Initial modulus [N/tex] | Work to break [J/g] | CV [%] |
|---|---|---|---|---|---|---|---|
| 20* | 2635 | 0 < DS < 1 | 530 | 4.2 | 19.4 | 12.2 | — |
| 21 | 506 | 0 < DS < 1 | 1027 | 5.6 | 27.6 | 28.2 | — |
| 22 | 493 | 0 < DS < 1 | 967 | 6.3 | 24.9 | — | — |
| 23 | 488 | 0 < DS < 1 | 1011 | 5.9 | 26.2 | — | — |

We claim:

1. A process for preparing regenerated cellulose filaments from an anisotropic solution comprising cellulose formate, phosphoric acid, and formic acid, which process comprises the steps of:

a) extruding the solution through capillaries to form cellulose formate filaments, b) passing the cellulose formate filaments through a layer of air, c) passing the cellulose formate filaments through a coagulation bath, d) washing the cellulose formate filaments with water, e) drying the cellulose formate filaments to a moisture content of less than 20%, f) regenerating the cellulose formate filaments, g) washing the regenerated cellulose filaments with water under a tension of less than 2.5 cN/tex, h) drying the regenerated cellulose filaments under a tension of less then 2.5 cN/tex and j) winding the regenerated cellulose filaments.

2. A process according to claim 1, wherein the tension on the cellulose formate filaments measured immediately after step c is less than 2 cN/tex.

3. A process according to claim 2. wherein the tension on the cellulose formate filaments measured immediately after step c is less than 1 cN/tex.

4. A process according to claim 1, wherein, during steps d and/or e, the cellulose formate filaments are washed and/or dried under a tension between 4 and 16 cN/tex.

5. A process according to claim 1, characterised in that the filaments are regenerated and then washed, dried, and wound under a tension of less than 1 cN/tex.

6. A process according to claim 1, characterised in that the regenerated filaments are dried in two steps, with the tension on the filaments between the two drying steps being less than 0.5 cN/tex.

7. A process according to claim 1, characterised in that the cellulose used to prepare the spinning solution has a degree of polymerisation (DP) in the range of 350 to 1500.

* * * * *

UNITED STATES PATENT AND TRADEMARK OFFICE

CERTIFICATE OF CORRECTION

PATENT NO. : 5,997,790

DATED : December 7, 1999

INVENTOR(S) : Vos et al.

It is certified that error appears in the above-identified patent and that said Letters Patent is hereby corrected as shown below:

Column 1, line 25: "SUMMARY OF THE INVENTION" should be deleted;
Column 1, line 28: "WO 85/05115." should read --WO 85/05115. ¶SUMMARY OF THE INVENTION--;
Column 2, lines 5-6: "DESCRIPTION OF PREFERRED EMBODIMENTS" should be deleted;
Column 2, line 12: "yarn." should read --yarn. ¶DESCRIPTION OF PREFERRED EMBODIMENTS--;
Column 2, lines 17-18: "in ¶WO 85/05115" should read --in WO 85/05115--;
Column 2, line 19: "hosphoric" should read --phosphoric--;
Column 3, line 3: "10 000" should read --10,000; and "2000" should read --2,000--;
Column 6, line 14: "a" should read --A--;
Column 6, line 29: "tyres" should read --tires--;
Column 6, line 30: "cars" should read --cars--;
Column 6, line 55: "$c(k \times c \times (visc.\ rat.-1))$" should read -- $c+(k \times c \times (visc.\ rat.-1))$ --;
Column 6, line 64: "0,42" should read -- 0.42 --;
Column 7, line 1: "2,29" should read -- 2.29 --;
Column 7, line 55: "20° C.," should read -- 120° C., --;
Column 8, line 22: "4000√linear" should read -- 4000/√linear --;
Column 9, line 11: "mNttex" should read -- mN/tex --;
Column 11, line 10: "8.5%)." should read -- 8.5%. --;
Column 11, line 56: "was," should read -- was --;
Column 12, line 21: "and," should read -- and --;
Column 15, line 4: "783" should read -- 78 --;
Column 15, line 40: "79)" should read -- 79 --;
Column 15, line 54: "Of" should read -- of --;

Signed and Sealed this

Twenty-second Day of May, 2001

*Attest:*

Nicholas P. Godici

NICHOLAS P. GODICI

*Attesting Officer*

*Acting Director of the United States Patent and Trademark Office*